US008754736B2

(12) United States Patent
Groves et al.

(10) Patent No.: US 8,754,736 B2
(45) Date of Patent: Jun. 17, 2014

(54) INDUCTOR STRUCTURE HAVING INCREASED INDUCTANCE DENSITY AND QUALITY FACTOR

(75) Inventors: Robert A. Groves, Highland, NY (US); Arvind Narayanan, Bangalore, IN (US); Venkata N. R. Vanukuru, Bangalore, IN (US)

(73) Assignee: International Business Machines Corporation, Armonk, NY (US)

( * ) Notice: Subject to any disclaimer, the term of this patent is extended or adjusted under 35 U.S.C. 154(b) by 348 days.

(21) Appl. No.: 13/012,027

(22) Filed: Jan. 24, 2011

(65) Prior Publication Data

US 2012/0188047 A1 Jul. 26, 2012

(51) Int. Cl.
*H01F 5/00* (2006.01)
*H01F 27/28* (2006.01)

(52) U.S. Cl.
USPC ..... 336/200; 336/232

(58) Field of Classification Search
USPC ..... 336/200, 232
See application file for complete search history.

(56) References Cited

U.S. PATENT DOCUMENTS

| | | | | |
|---|---|---|---|---|
| 7,053,460 | B2 | 5/2006 | Volant et al. | |
| 7,126,451 | B2 * | 10/2006 | Maruyama | 336/200 |
| 7,129,561 | B2 | 10/2006 | Coolbaugh et al. | |
| 7,262,680 | B2 * | 8/2007 | Wang | 336/200 |
| 7,400,025 | B2 * | 7/2008 | Pitts et al. | 257/531 |
| 7,598,836 | B2 * | 10/2009 | Lee | 336/147 |
| 8,441,333 | B2 | 5/2013 | Chiu et al. | |
| 2004/0103522 | A1 * | 6/2004 | Ahn et al. | 29/602.1 |
| 2009/0315662 | A1 * | 12/2009 | Hijioka et al. | 336/200 |
| 2011/0133875 | A1 | 6/2011 | Chiu et al. | |
| 2012/0188047 | A1 | 7/2012 | Groves et al. | |

* cited by examiner

*Primary Examiner* — Tsz Chan
(74) *Attorney, Agent, or Firm* — Catherine Ivers; Ira D. Blecker

(57) ABSTRACT

Disclosed is an inductor structure. The inductor structure includes a base material, at least one bottom spiral conductor disposed on the base material, a middle spiral conductor disposed on the bottom spiral conductor, a top spiral conductor disposed on the middle spiral conductor, and dielectric material separating the bottom, middle and top spiral conductors. The at least one bottom spiral conductor is connected electrically in parallel to the middle spiral conductor and the middle spiral conductor is connected electrically in series to the top spiral conductor. The top spiral conductor is thicker, narrower and less tightly wound than the middle spiral conductor and the bottom spiral conductor.

21 Claims, 6 Drawing Sheets

INDUCTOR STRUCTURE HAVING INCREASED INDUCTANCE DENSITY AND QUALITY FACTOR

BACKGROUND

The present invention relates to the field of inductors, and particularly, to series parallel inductors having a high quality factor and a high inductance density built on a base material such as a semiconductor material.

In the semiconductor industry, digital and analog circuits, including complex microprocessors have been successfully implemented in semiconductor integrated circuits. Such integrated circuits may typically include active devices such as, for example, field effect transistors, and passive devices such as, for example, resistors, capacitors and inductors.

It is desirable to have an inductor with a high quality factor Q and a high inductance density. However, it is difficult to obtain a high quality factor Q while also maintaining a high inductance density. In conventional designs, the quality factor Q or inductance density usually is less than desirable.

BRIEF SUMMARY

The various advantages and purposes of the exemplary embodiments as described above and hereafter are achieved by providing, according to a first aspect of the exemplary embodiments, an inductor structure. The inductor structure includes a base material; at least one bottom spiral conductor disposed on the base material; a middle spiral conductor disposed on the bottom spiral conductor; a top spiral conductor disposed on the middle spiral conductor; and dielectric material separating the bottom, middle and top spiral conductors; wherein the at least one bottom spiral conductor is connected electrically in parallel to the middle spiral conductor and the middle spiral conductor is connected electrically in series to the top spiral conductor.

According to a second aspect of the invention, there is provided an inductor structure. The inductor structure includes a base material; at least one bottom spiral conductor disposed on the base material; a middle spiral conductor disposed on the bottom spiral conductor; a top spiral conductor disposed on the middle spiral conductor; and dielectric material separating the bottom, middle and top spiral conductors; wherein the at least one bottom spiral conductor is connected electrically in parallel to the middle spiral conductor and the middle spiral conductor is connected electrically in series to the top spiral conductor; wherein the bottom spiral conductor, middle spiral conductor and top spiral conductor each have a thickness measured vertically from the base material such that the thickness of the bottom spiral conductor and the thickness of the middle spiral conductor is less than the top spiral conductor; and wherein the bottom spiral conductor, middle spiral conductor and top spiral conductor each have a sheet resistance and the sheet resistance of the bottom spiral conductor and the sheet resistance of the middle spiral conductor is higher than the sheet resistance of the top spiral conductor.

BRIEF DESCRIPTION OF SEVERAL VIEWS OF THE DRAWINGS

The features of the exemplary embodiments believed to be novel and the elements characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION

Figure 1A:
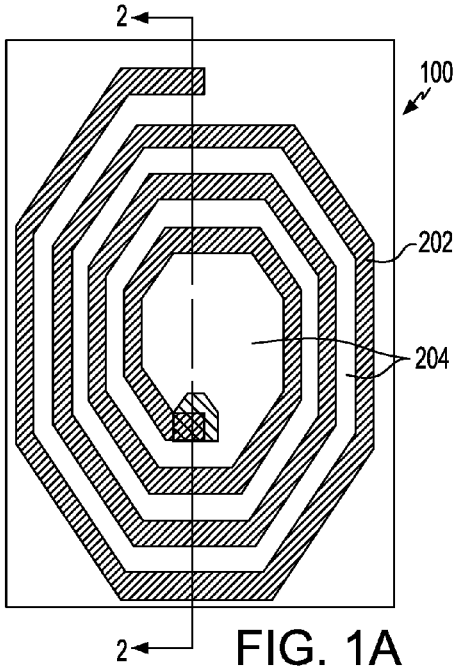
FIGS. 1A, 1B and 1C are plan views of a top spiral conductor, a middle spiral conductor and a bottom spiral conductor, respectively, according to exemplary embodiments.
Figure 1B:
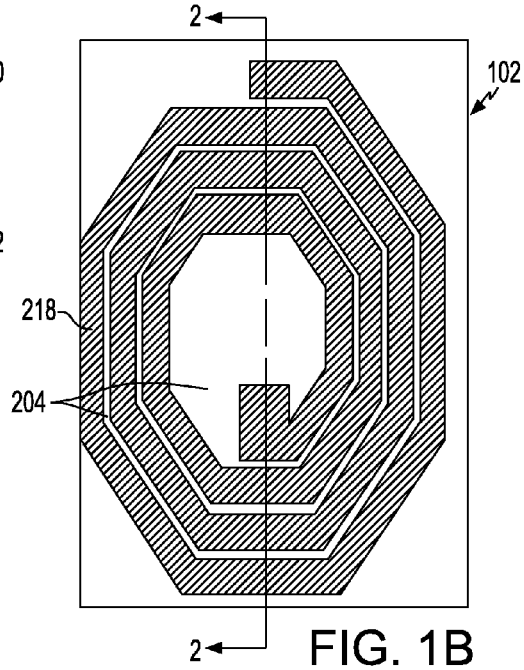
Figure 1C:
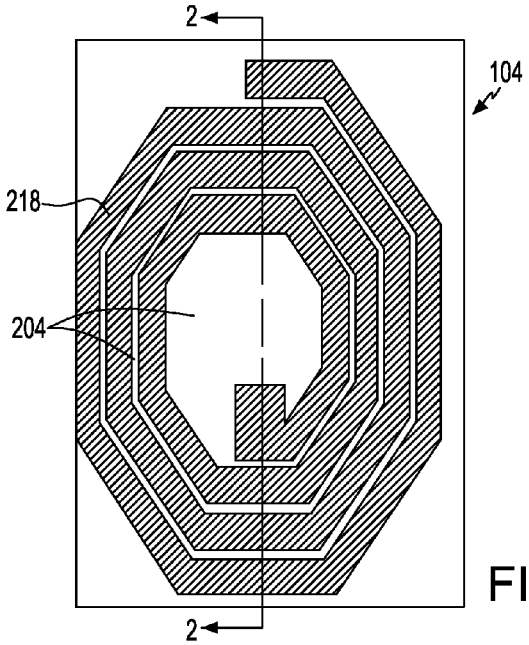

Referring first to FIGS. 1A, 1B and 1C, there are shown plan views of at least three conductors having spiral turns for use in fabricating an inductor of the exemplary embodiments. Throughout this specification, conductors having spiral turns may also be referred to as spiral conductors and both descriptions are deemed to be equivalent. FIG. 1A illustrates the spiral turns of a top conductor 100, FIG. 1B illustrates the spiral turns of a middle conductor 102 and FIG. 1C illustrates the spiral turns of a bottom conductor 104. There may be more than one bottom conductor layer 104. In use, the top spiral turns of conductor 100 would be placed on top of middle spiral turns of conductor 102 which would then be placed on top of the bottom spiral turns of conductor(s) 104. Dielectric material is formed between the spiral turns of the conductors 100, 102, and 104, between the various conductors 100, 102, and 104 to separate the spiral conductors 100, 102, and 104 and around the various conductors 100, 102 and 104 to separate them from adjacent electrical wiring.

The conductors 100, 102, and 104 in FIGS. 1A, 1B and 1C are for illustration of one exemplary embodiment and the number of spiral turns, width of the spiral turns and spacing of the spiral turns may vary in other exemplary embodiments shown in the following Figures.

Figure 2:
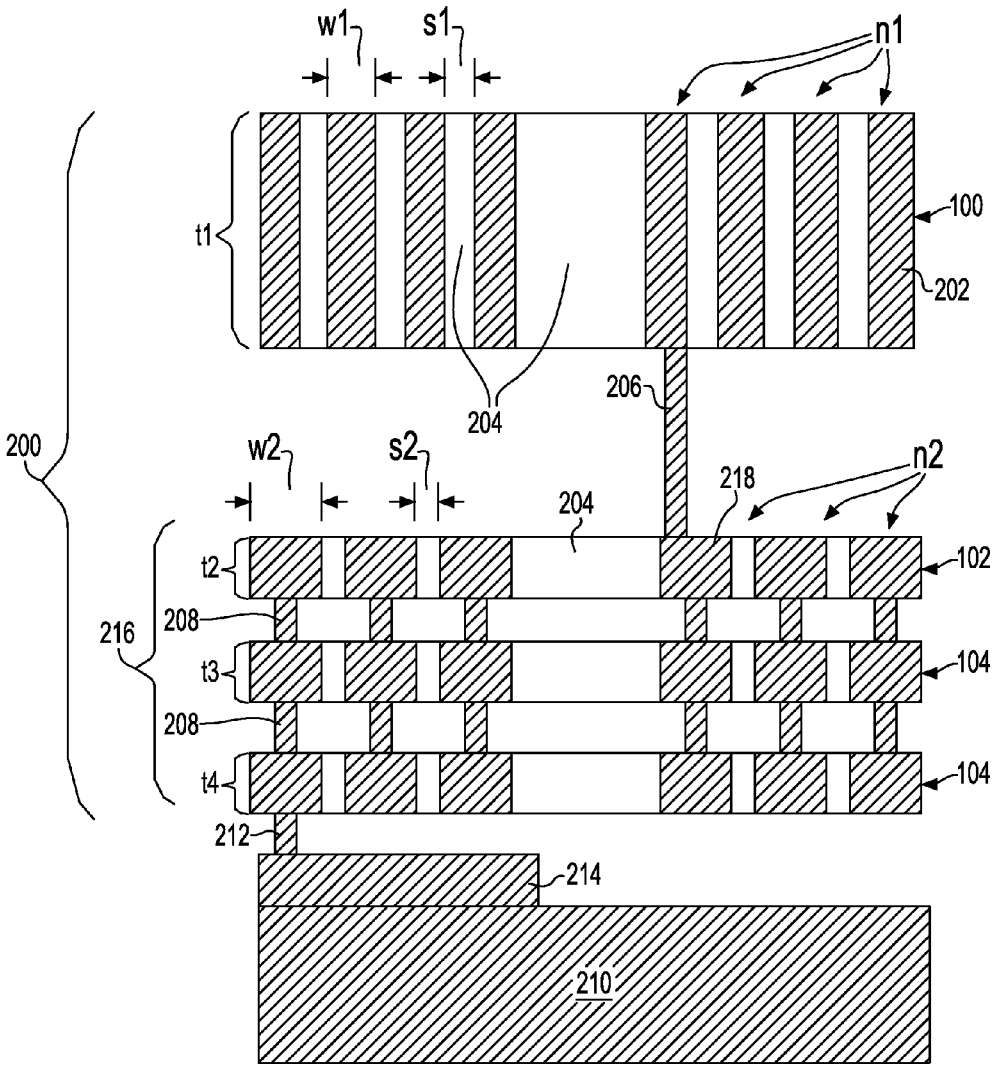
FIG. 2 is a cross sectional view of a multilayer inductor according to a first exemplary embodiment.

FIG. 2 illustrates a cross sectional view of an exemplary embodiment of an inductor 200 which includes the various spiral conductors 100, 102, 104 shown in FIG. 1 in the direction of arrows 2-2 plus insulating dielectric material and connecting vias. The number of spiral turns, width of the spiral turns and spacing of the spiral turns of each of the spiral conductors 100, 102, and 104 may differ in the following cross-sectional views for other exemplary embodiments when compared to the plan views provided for illustration purposes only in FIGS. 1A, 1B and 1C. Inductor 200 may include more than one bottom conductor 104. FIG. 2 shows an additional bottom conductor layer 104 and there may be additional bottom conductor layers 104 (not shown) to meet electrical design requirements.

Top spiral conductor 100 has low sheet resistance compared to the remaining conductors of the inductor 200. The top conductor 100 includes the spiral turns 202 which have conventional dielectric material 204 between the spiral turns 202. Top conductor 100 may be made from aluminum or copper.

Conductors 102 and 104 make up a group 216 of thin metallization layers comprising spiral turns 218 with conventional dielectric material 204 between the turns 218. The spiral turns 202 in conductor 100 have an equal or greater number of complete turns plus fractional turns than the spiral turns 218 in conductors 102 and 104. The conductors of group 216 have a higher sheet resistance than the conductor 100. The conductors of group 216 may be made from copper.

The top conductor 100 is electrically connected to middle conductor 102 by via 206. Middle conductor 102 is connected to bottom conductor 104 by vias 208. If there is more than one bottom conductor 104, then each of these conductors are also connected by vias 208. Vias 206 and 208 may be made from copper.

The inductor 200 is disposed on base 210 and may be connected to a metal inter-circuit connection 214 by via 212. Base 210 may be made from an insulating material or, more usually, it will be made from a semiconducting material. When base 210 is a semiconducting material, there will usually be metal wiring layers on the semiconducting material. These metal wiring layers are called the back end of the line layers and the inductor 200 may be formed in the back end of the line layers.

The top conductor 100 has a thickness "t1" measured in a vertical direction from the base 210 while the middle conductor 102 has a thickness t2 and bottom conductor(s) have thicknesses "t3-t4" as shown in FIG. 2. The spiral turns 202 in conductor 100 have a width "w1" measured in a direction parallel to the base 210 while the spiral turns 218 of conductor group 216 have a width "w2" measured in a direction parallel to the base 210. The spiral turns 202 in conductor 100 have a number of turns "n1" indicating the number of complete turns plus fractional turns in the spiral while the spiral turns 218 of conductor group 216 have a number of turns "n2" indicating the number of complete turns plus fractional turns in that spiral. The spiral turns 202 in conductor 100 have a spacing "s1" measured in a direction parallel to the base 210 while the spiral turns 218 of conductor group 216 have a spacing "s2" measured in a direction parallel to the base 210. The top conductor 100 will have a thickness t1 which is greater than the thickness t2 of middle conductor 102. The top conductor thickness t1 will also be thicker than the thicknesses t3 and t4, of the bottom spiral conductor(s) 104. For purposes of illustration and not limitation, top conductor 100 may have a thickness of about 2 to 4 μm (micro-meters) while the middle conductor 102 and the bottom conductor(s) 104 each may have a thickness of about 0.2 to 1 μm.

The top spiral turns 202 will have a width w1 which is less than the width w2 of the spiral turns 218 of conductor group 216. For purposes of illustration and not limitation, the top spiral turns may have a width of about 5 μm to 10 μm while the conductor layers comprising the spiral turns 218 of conductor group 216 may each have a width of about 5 to 50 μm.

The spacing s2 of the spiral turns 218 of the conductor group 216 will be less than the spacing s1 of the spiral turns 202 of the top conductor 100.

In general, the widths and spacing of all of the parallel connected conductors 102 and 104 in each conductor group should have the same width, w2, and spacing, s2.

The number of turns n1 of the top spiral turns 202 will be greater than or equal to the number of turns n2 of the spiral turns 218 of spiral conductor group 216.

Thus, it can be seen that the top spiral turns 202 of conductor 100 will be thicker, narrower and less tightly wound than the spiral turns 218 of conductor group 216.

Top spiral conductor 100 will be connected electrically in series with middle conductor 102 by via 206. Middle conductor 102 will be connected electrically in parallel with bottom conductor 104 by multiple vias 208. If there is more than one bottom conductor 104, then each bottom conductor 104 will be connected in parallel by vias 208. Vias 208 may also be bars. Bottom conductors 104 may be added until the layers in the back end of the line wiring are exhausted or until the electrical design requirements are met.

The thicker but narrower top spiral turns 202 result in higher inductance and also higher Q. The spiral turns 218 have wider but thinner conductors. The wider conductor of the spiral turns 218 result in higher Q. However, the wider lower metals connected in parallel may reduce the inductance density. By using the advantage of the smaller conductor to conductor spacing and the wider conductor of the spiral turns 218, inductance density is improved.

Figure 3:
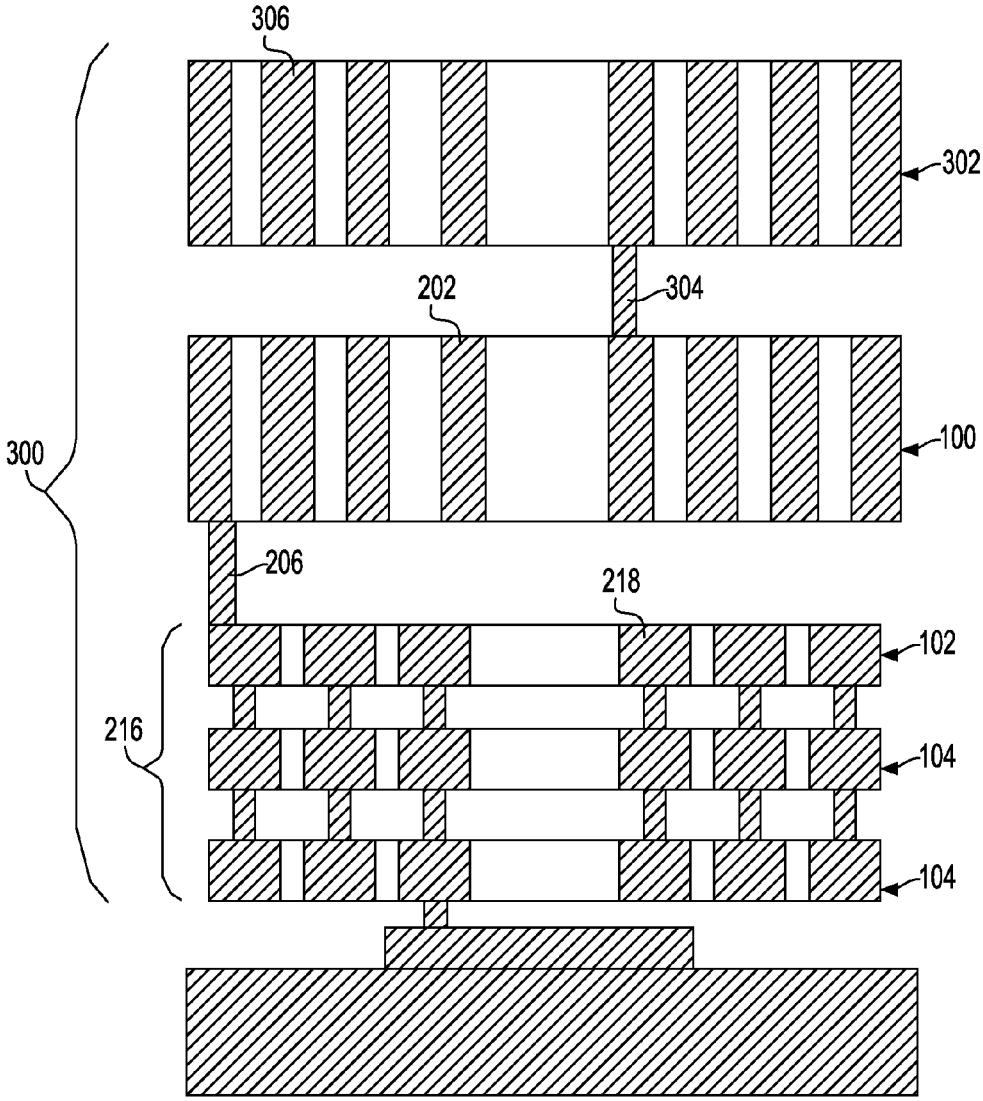
FIG. 3 is a cross sectional view of a multilayer inductor according to a second exemplary embodiment.

Referring now to FIG. 3, there is shown another exemplary embodiment of an inductor according to the present invention. Inductor 300 is similar to inductor 200 in FIG. 2 except that the inductor 300 in FIG. 3 now includes at least one additional top spiral conductor 302 comprising spiral turns 306. The top conductor 302 is connected electrically in series to top conductor 100. Top conductor 302 will be similar to top conductor 100 in that both top conductors 100 and 302 are comprised of thick conductors as compared to all conductors in spiral conductor group 216. The thicknesses of spiral conductors 100 and 302 are not required to be equal, nor are the width, space and number of turns of spiral turns 202 and 306 required to be equal. Both spiral turns 202 and 306 will satisfy the following relationships to all conductors in the spiral turns 218 of conductor group 216: 1) width of spiral turns 202 and spiral turns 306 are less than the width of spiral turns 218; 2) space of spiral turns 202 and spiral turns 306 are greater than the space of spiral turns 218; 3) number of turns of spiral turns 202 and spiral turns 306 is greater than or equal to the number of turns of spiral turns 218.

Figure 4:
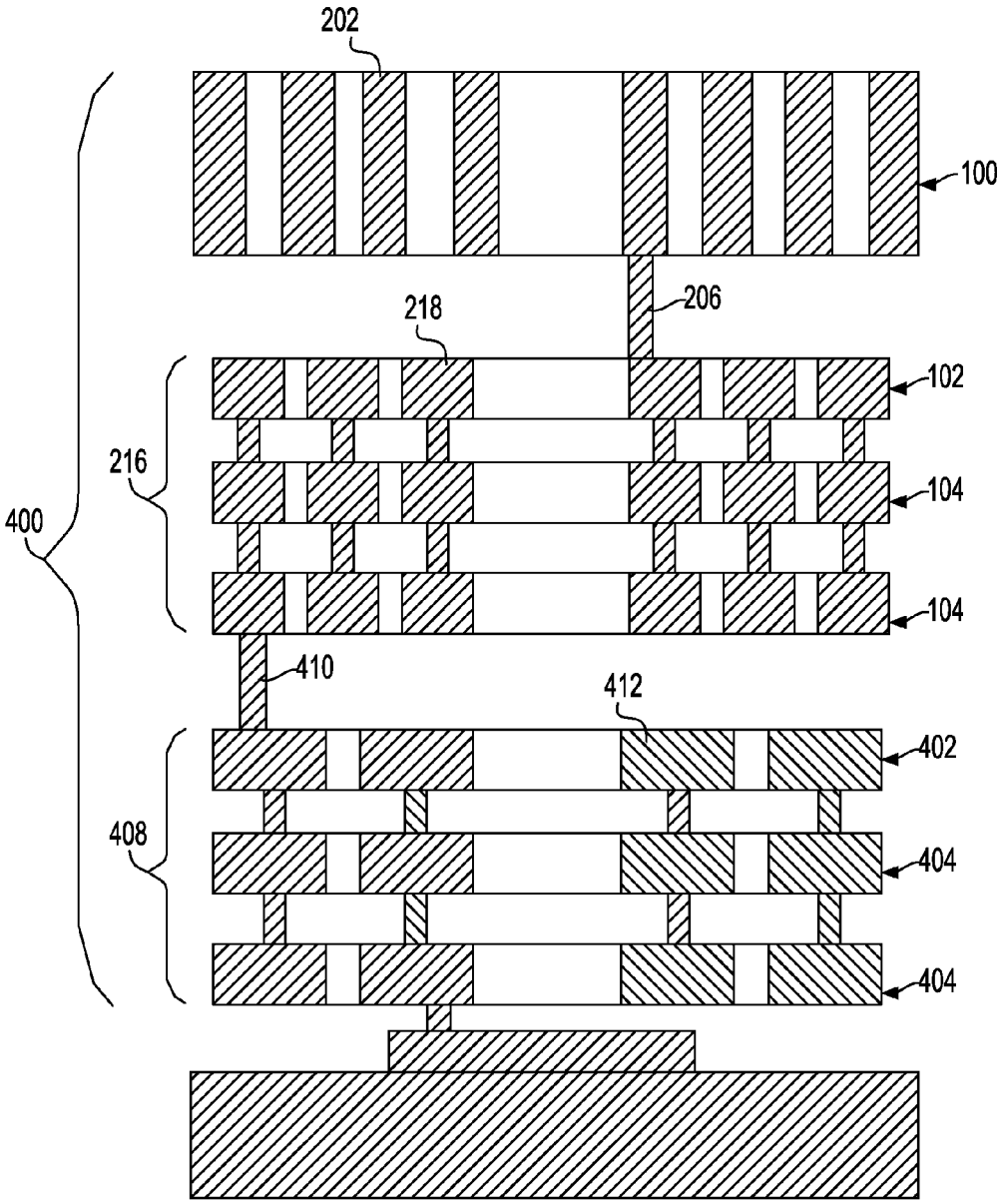
FIG. 4 is a cross sectional view of a multilayer inductor according to a third exemplary embodiment.

Referring now to FIG. 4, there is shown a further exemplary embodiment of an inductor according to the present invention. Inductor 400 is similar to inductor 200 in FIG. 2 with an additional spiral conductor group 408. As shown in FIG. 4, middle conductor 102 and bottom conductor(s) 104 make up a group 216 of thin metalization layers, comprising turns 218, which are connected electrically in series by via 206 to top spiral conductor 100, comprising turns 202, as was the case with inductor 200 in FIG. 2. Inductor 400 now includes at least one additional group 408, comprising turns 412 of thin metalization layers including middle conductor 402 and one or more bottom conductors 404. There may be other such groups 408 of thin metalization layers as electrical requirements may dictate and as the structure of the back end of the line wiring layers may allow (assuming the structure is built on a semiconductor base material). The thicknesses of conductors 102, 104, 402, and 404 are not required to be equal, nor are the width, space and number of spiral turns in conductor group 216 and the width, space and number of spiral turns in conductor group 408 required to be equal. Each spiral conductor layer in groups 216 and 408 may have different thicknesses from each other, with the single requirement being that all spiral conductors in groups 216 and 408 must be thinner than spiral conductor 100. Group 408 of thin metalization layers is connected electrically in series by via 410 to group 216 of thin metalization layers. Within group 408 of thin metalization layers, each of the thin metalization layers 402 and 404 are connected electrically in parallel. Spiral turns 202 will satisfy the following relationships to spiral turns 218 and 412: 1) width of spiral turns 202 is less than the width of spiral turns 218 and spiral turns 412; 2) space of spiral turns 202 is greater than the space of spiral turns 218 and spiral turns 412; 3) number of turns of spiral turns 202 is greater than or equal to the number of turns of spiral turns 218 and spiral turns 412.

Figure 5:
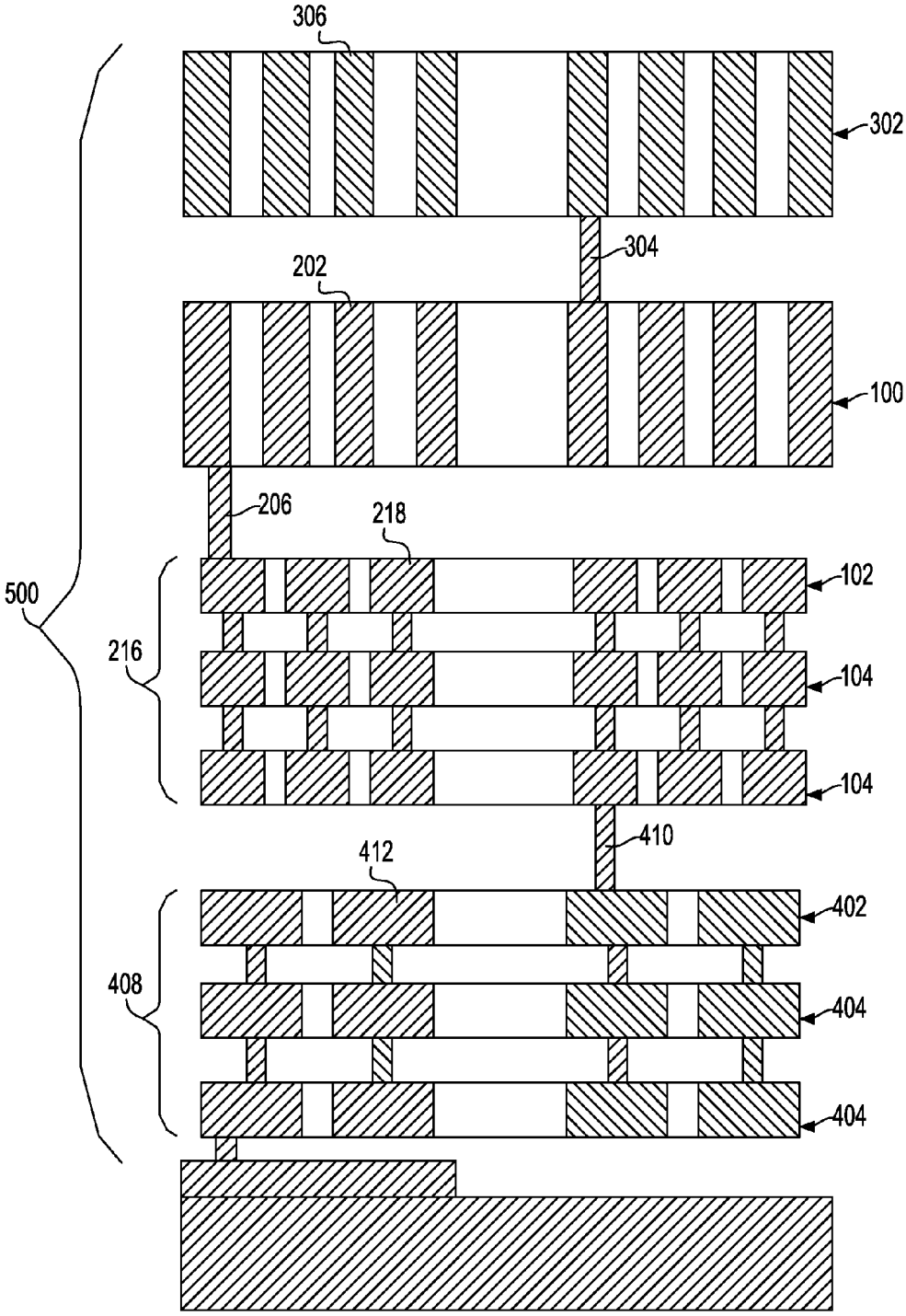
FIG. 5 is a cross sectional view of a multilayer inductor according to a fourth exemplary embodiment.

Referring now to FIG. 5, there is shown another exemplary embodiment of an inductor according to the present invention. Inductor 500 is similar to inductor 400 in FIG. 4 except that the inductor 500 in FIG. 5 now includes at least one additional top, thick spiral conductor 302, comprising spiral turns 306 similar to inductor 300. The thickness of spiral conductor 302 is not required to be equal to the thickness of spiral conductor 100. The top spiral conductor 302 is connected electrically in series to top spiral conductor 100 through via 304. Spiral turns 202 and spiral turns 306 will satisfy the following relationships to spiral turns 218 and spiral turns 412: 1) Width of spiral turns 202 and spiral turns 306 are less than the width of spiral turns 218 and spiral turns 412; 2) space of spiral turns 202 and spiral turns 306 are greater than the space of spiral turns 218 and spiral turns 412; 3) number of turns of spiral turns 202 and spiral turns 306 are greater than or equal to the number of turns of spiral turns 218 and spiral turns 412.

Various exemplary embodiments have been discussed above in regards to FIGS. 2 to 5. The present inventors have proposed a methodology for determining the type of conductor layers and whether the layers are connected electrically in series or parallel for the series parallel inductor of the exemplary embodiments. The methodology is presented in FIG. 6.

Figure 6:
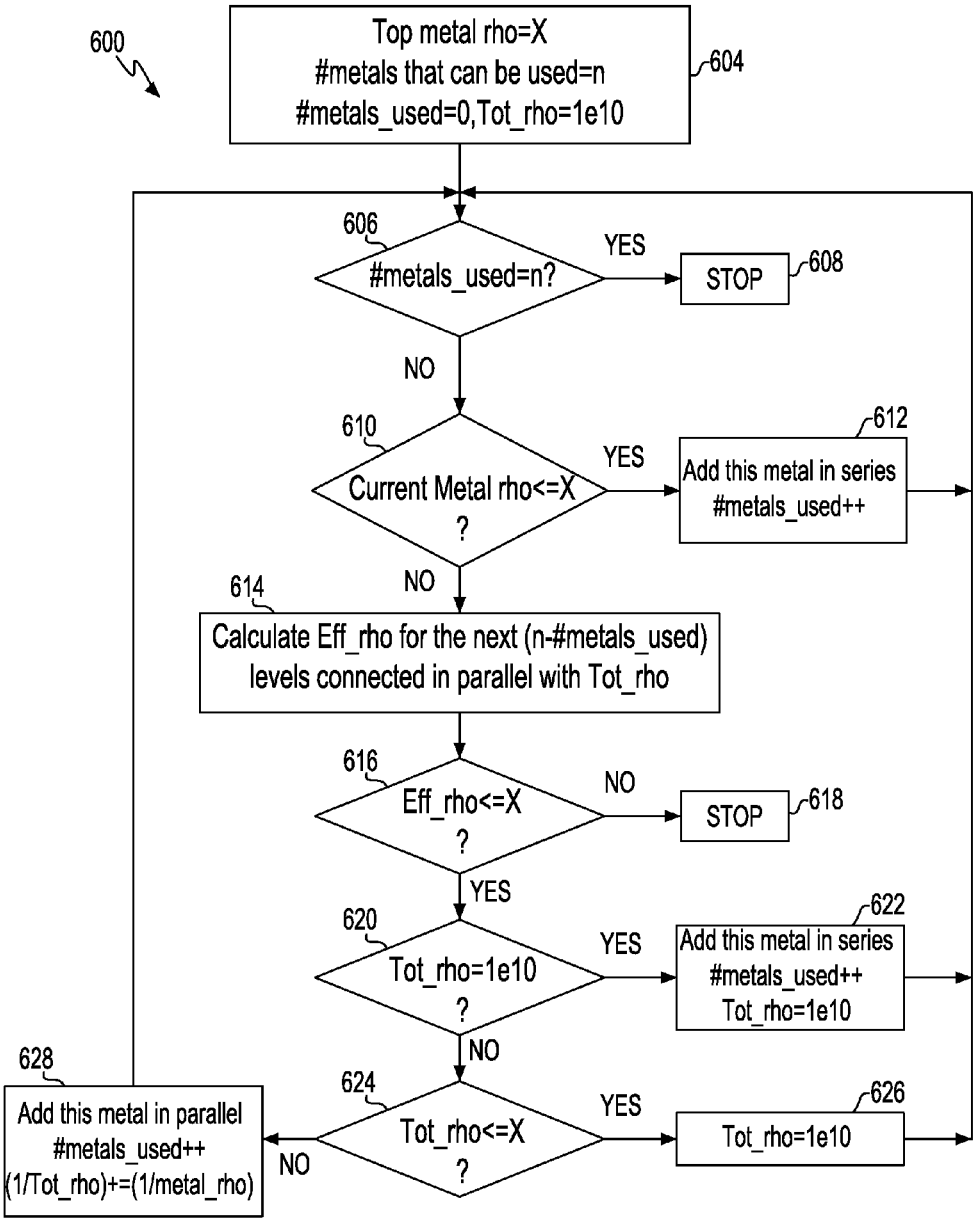
FIG. 6 is a flow chart of a process for optimizing quality factor Q and inductance.

Referring now to FIG. 6, the methodology 600 is described. First, parameters are initialized in box 604. The sheet resistance (rho) of the top spiral conductor is set to "X", the number of metallization layers is set to "n", the number of metallization layers used is set to "0" and the total sheet resistance ("total rho") of the inductor is set to a very large number such as $1\times10^{10}$.

It is next determined whether the number of metallization layers used thus far equals "n" as indicated in decision box 606. If the answer is "yes", the process stops, box 608, indicating that the available number of metallization layers have been utilized in forming the inductor and there are no more metallization layers available. If the answer is "no", the process continues.

It is necessary to determine the sheet resistance of the next metallization layer, decision box 610. If the sheet resistance of the metallization layer to be added is less than or equal to "X", then this is a top metallization layer and it is added in series, box 612. The number of metallization layers used is incremented. If the sheet resistance of the metallization layer to be added is greater than "X", then this is a thin metallization layer and the process continues to the next step.

In the next step, the effective sheet resistance for the remaining available thin metal layers (if any) connected in parallel with any thin metal layers already added in parallel is determined, box 614. This is done by calculating the effective parallel sheet resistance of the remaining thin metal layers placed in parallel with the value of Tot_rho, which represents the value of any already parallel connected thin metal layers.

If the effective sheet resistance calculated in box 614 is greater than the sheet resistance "X" of the top metallization layer, decision box 616, then sufficient thin metallization layers do not exist and the process stops, box 618. However, if the effective sheet resistance calculated in box 614 is less than or equal to the sheet resistance "X" of the top metallization layer, then the process proceeds to the next step to add more metallization layers.

It is next determined if the total rho (used later to calculate the total sheet rho due to multiple levels being connected in parallel) equals $1\times10^{10}$. When the first thin metallization layer is added and decision box 620 is encountered, the total rho of the inductor will equal the initialization value of $1\times10^{10}$ and so the "yes" path is taken. This first thin metallization layer will be connected to the previous thick metallization layer in series as indicated in FIGS. 2 to 5. Thereafter, the value of total rho is set to the sheet resistance of the thin metallization layer, the number of metallization layers is incremented and the thin metallization layer is added in series, box 622. The next time a thin metallization layer encounters decision box 620, total rho will have the value of the sheet resistance of the thin metallization layer which will be less than $1\times10^{10}$ and so the "no" path will be taken for the next thin metallization layer.

Thereafter, it is determined if the total rho is less than or equal to "X", decision box 624. If total rho is less than or equal to "X", the "yes" path is taken and total rho is given the value of $1\times10^{10}$, box 626. However, if the total rho is greater than the value of "X", then the "No" path is taken. The thin metallization layer is added in parallel and the number of metallization layers used is incremented, box 628. The equation in box 628–(1/total rho)+=(1/metal rho)–implies (1/total rho)=(1/total rho)+(1/metal/rho) which essentially is calculating the reduction in the total sheet resistance due to the addition of the current thin metal in parallel.

The process continues until all thick and thin metallization layers have been added electrically in parallel or series and the number of metallization layers equals the number of metallization layers available for the spiral.

It should be understood that the inductors shown in FIGS. 1 to 5 only reflect part of the semiconductor structure when built on a semiconductor base. The semiconductor structure may also include transistors, capacitors, resistors, etc. which are not shown for clarity. It is also understood that after formation of the inductors shown herein, normal semiconductor processing may proceed.

It will be apparent to those skilled in the art having regard to this disclosure that other modifications of the exemplary embodiments beyond those embodiments specifically described here may be made without departing from the spirit of the invention. Accordingly, such modifications are considered within the scope of the invention as limited solely by the appended claims.

What is claimed is:

1. An inductor structure comprising:

a base material;

at least one bottom spiral conductor disposed on the base material, the at least one bottom spiral conductor having a plurality of turns;

a middle spiral conductor disposed on the bottom spiral conductor, the middle spiral conductor having a plurality of turns;

a top spiral conductor disposed on the middle spiral conductor, the top spiral conductor having a plurality of turns; and dielectric material separating the bottom, middle and top spiral conductors;

wherein the at least one bottom spiral conductor is connected electrically in parallel to the middle spiral conductor and the middle spiral conductor is connected electrically in series to the top spiral conductor; and wherein the bottom spiral conductor, middle spiral conductor and top spiral conductor each comprises a conductor material that has a width in cross section of each turn of the bottom spiral conductor, middle spiral conductor and top spiral conductor and a turn to turn spacing measured in a direction parallel to the base material wherein the width of the conductor material of each turn of the bottom spiral conductor and the width of the conductor material of each turn of the middle spiral conductor is greater than the width of the conductor material of each turn of the top spiral conductor and wherein the turn to turn spacing of the bottom spiral conductor and the turn to turn spacing of the middle spiral conductor is smaller than or equal to the turn to turn spacing of the top spiral conductor.

2. The inductor structure of claim 1 further comprising vias and wherein the parallel and series connections are provided by the vias connecting the bottom, middle and top spiral conductors.

3. The inductor structure of claim 1 wherein the bottom spiral conductor, middle spiral conductor and top spiral conductor each have a thickness measured in a direction vertically from the base material such that the thickness of the bottom spiral conductor and the thickness of the middle spiral conductor is less than the thickness of the top spiral conductor.

4. The inductor structure of claim 1 wherein the bottom spiral conductor, middle spiral conductor and top spiral conductor each have a number of turns measured as the number of complete turns plus fractional turns in the spiral wherein the number of turns of the top spiral conductor is greater than or equal to the number of turns of the bottom spiral conductor and the number of turns of the middle spiral conductor.

5. The inductor structure of claim 1 wherein the bottom spiral conductor, middle spiral conductor and top spiral conductor each have a sheet resistance and the sheet resistance of the bottom spiral conductor and the sheet resistance of the middle spiral conductor is higher than the sheet resistance of the top spiral conductor.

6. The inductor structure of claim 5 wherein the bottom spiral conductor and middle spiral conductor comprise copper and the top spiral conductor comprises aluminum.

7. The inductor structure of claim 5 wherein the bottom spiral conductor. middle spiral conductor, and the top spiral conductor comprise copper.

8. The inductor structure of claim 1 wherein the base material is an insulating material.

9. The inductor structure of claim 1 wherein the base material is a semiconductor material.

10. The inductor structure of claim 1 wherein there are a plurality of bottom spiral conductor layers with the plurality of bottom spiral conductor layers being connected in parallel.

11. The inductor structure of claim 1 wherein there is at least one additional top spiral conductor connected in series to the top spiral conductor.

12. An inductor structure comprising:

a base material;

at least one bottom spiral conductor disposed on the base material, the at least one bottom spiral conductor having a plurality of turns;

a middle spiral conductor disposed on the bottom spiral conductor, the middle spiral conductor having a plurality of turns;

a top spiral conductor disposed on the middle spiral conductor, the top spiral conductor having a plurality of turns; and dielectric material separating the bottom, middle and top spiral conductors;

wherein the at least one bottom spiral conductor is connected electrically in parallel to the middle spiral conductor and the middle spiral conductor is connected electrically in series to the top spiral conductor;

wherein the bottom spiral conductor, middle spiral conductor and top spiral conductor each have a thickness measured in a vertical direction from the base material such that the thickness of the bottom spiral conductor and the thickness of the middle spiral conductor is less than the top spiral conductor; and wherein the bottom spiral conductor, middle spiral conductor and top spiral conductor each have a sheet resistance and the sheet resistance of the bottom spiral conductor and the sheet resistance of the middle spiral conductor is higher than the sheet resistance of the top spiral conductor; and wherein the bottom spiral conductor, middle spiral conductor and top spiral conductor each comprise a conductor material that has a width in cross section of each turn of the bottom spiral conductor, middle spiral conductor and top spiral conductor and a turn to turn spacing measured in a direction parallel to the base material wherein the width of the conductor material of each turn of the bottom spiral conductor and the width of the conductor material of each turn of the middle spiral conductor is greater than the width of the conductor material of each turn of the top spiral conductor and wherein the turn to turn spacing of the bottom spiral conductor and the turn to turn spacing of the middle spiral conductor is smaller than or equal to the turn to turn spacing of the top spiral conductor.

13. The inductor structure of claim 12 further comprising vias and wherein the parallel and series connections are provided by the vias connecting the bottom, middle and top spiral conductors.

14. The inductor structure of claim 12 wherein the bottom spiral conductor, middle spiral conductor and top spiral conductor each have a number of turns measured as the number of complete turns plus fractional turns in the spiral wherein the number of turns of the top spiral conductor is greater than or equal to the number of turns of the bottom spiral conductor and the number of turns of the middle spiral conductor.

15. The inductor structure of claim 12 wherein the bottom spiral conductor and middle spiral conductor comprise copper and the top spiral conductor comprises aluminum.

16. The inductor structure of claim 12 wherein the bottom spiral conductor. middle spiral conductor, and the top spiral conductor comprises copper.

17. The inductor structure of claim 12 wherein the base material is an insulating material.

18. The inductor structure of claim 12 wherein the base material is a semiconductor material.

19. The inductor structure of claim 12 wherein there are a plurality of bottom spiral conductor layers with the plurality of bottom spiral conductor layers being connected electrically in parallel.

20. The inductor structure of claim 12 wherein there is at least one additional top spiral conductor connected in series to the top spiral conductor.

21. The inductor structure of claim 12 wherein the at least one bottom spiral conductor and middle spiral conductor form a first group of spiral conductors connected in series to the top spiral conductor and further comprising at least one additional group comprising at least one bottom spiral conductor and a middle spiral conductor, the at least one additional group connected electrically to the first group in series.

* * * * *